United States Patent [19]

Henson

[11] Patent Number: 5,054,581

[45] Date of Patent: Oct. 8, 1991

[54] SAFETY DEVICE FOR SECURING A LADDER TO AN AERIAL CABLE

[76] Inventor: Kenneth H. Henson, 180 Ridge Rd., Candler, N.C. 28715

[21] Appl. No.: 552,009

[22] Filed: Jul. 13, 1990

[51] Int. Cl.[5] ..... E06C 7/48

[52] U.S. Cl. ..... 182/206; 248/210

[58] Field of Search ..... 182/206, 121, 150; 248/210

[56] References Cited

U.S. PATENT DOCUMENTS

| | | | |
|---|---|---|---|
| 1,018,877 | 2/1912 | Chickering | 182/206 |
| 1,961,289 | 6/1934 | Gardner . | |
| 1,994,369 | 3/1935 | Risser . | |
| 2,963,104 | 12/1960 | Roth | 182/206 |
| 3,001,603 | 9/1961 | Kraus | 182/206 |
| 3,067,836 | 12/1962 | Carnicelli | 182/121 |
| 3,780,829 | 12/1973 | Wallingford | 182/206 |

*Primary Examiner*—Reinaldo P. Machado
*Attorney, Agent, or Firm*—David M. Carter

[57] ABSTRACT

There is provided a clamp for securing a ladder to an aerial cable such as telephone cable. The clamp includes first and second slots for attaching the clamp to adjacent rungs on the ladder. The clamp includes a locking mechanism, having a swivelable portion so that when the aerial cable contacts the swivelable portion the cable becomes fixed securely to the clamp thus safely supporting the ladder against the aerial cable.

16 Claims, 4 Drawing Sheets

SAFETY DEVICE FOR SECURING A LADDER TO AN AERIAL CABLE

BACKGROUND OF THE INVENTION

This relates ladder safety devices. More particularly, it relates to a means for stabilizing a ladder supported by an aerial cable.

A common tool of a utility repairman and installer is the ordinary ladder. However, it has been found that ladders are a common source of injury because of their inherent instability. Various devices have been used to stabilize ladders which are used for climbing utility poles. One such device is described in U.S. Pat. application Ser. No. 423,175 filed Oct. 16, 1989 titled Pole Gripping Ladder Stabilizing Device invented by Kenneth H. Henson who is also the inventor in the present application. The Henson prior patent application describes a stabilizing device which is designed to be clamped to the telephone pole itself. However, in many cases a repair or installation must take place between utility poles.

In some cases utility installers and repairmen simply lean the ladder against the telephone wire. Obviously this method is fraught with risk to the user. Attachments to ladders so that a ladder may be used at mid-span between utility poles have been described. Examples include U.S. Pat. No. 2,963,104 issued to Roth and U.S. Pat. No. 3,001,603 issued to Krause, both titled Conductor Spreaders and Ladder Hangers. The Roth and Krause patents show attachments at the far end of a ladder which include a plurality of slots which receive electrical conductors.

In a somewhat related area, U.S. Pat. No. 3,780,829 assigned to Valley Engineering, Inc. teaches the use of an attachment to a ladder for evacuating persons from chair aerial cable lifts. The Valley Engineering patent shows a hook mechanism which is clamped over the aerial cable near a chair having a person to be evacuated.

Other related patents include U.S. Pat. No. 1,994,369 issued to Risser and U.S. Pat. No. 1,961,289 issued to Garnder, both of which teach the use of attachments for ladders which contact a utility pole. However, it is believed that none of these above-described patents provide a commercially acceptable mechanism to safety use a ladder at mid-span between utility poles.

OBJECTS OF THE INVENTION

It is therefore one object of this invention to provide an improved means for stabilizing a ladder.

It is another object to provide a means for stabilizing a ladder which is used in conjunction with aerial cable.

It is another object to provide a device which enables a ladder to be more safety utilized in connection with aerial cable and which is easy to use.

SUMMARY OF THE INVENTION

In accordance with one form of this invention there is provided a safety device for use with a ladder which includes a clamp which is connected to a ladder between first and second rungs, preferably adjacent rungs. A first mechanism is provided for securing the clamp to the first rung and a second mechanism is provided for securing the clamp to the second rung. A locking mechanism is connected to the clamp for securing the clamp to an aerial cable. Preferably the locking mechanism includes a portion which is swivelably mounted on the clamp so that when the locking mechanism comes in contact with the aerial cable it will rotate to a position which securely affixes the aerial cable to the clamp and thus stabilizing the ladder.

In the preferred form of the invention, the clamp includes two parallel plates forming a gap or cavity therebetween so that the swivelable portion of the locking mechanism may rotate therebetween.

BRIEF DESCRIPTION OF THE DRAWINGS

The subject matter which is regarded as the invention is set forth in the appended claims. The invention itself, however, together with further objects and advantages thereof may be better understood by reference to the following description taken in conjunction with the accompanying drawings in which:

DESCRIPTION OF THE PREFERRED EMBODIMENT

Figure 2:
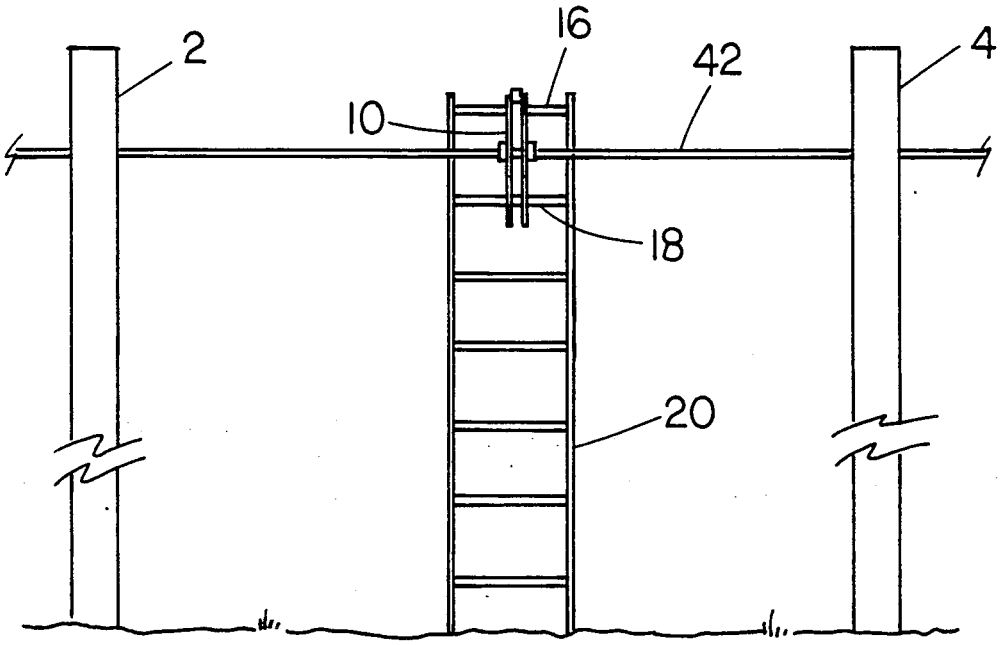
FIG. 2 is a pictorial view of a ladder resting against an aerial cable between two utility poles utilizing the apparatus of FIG. 1 to secure the ladder to the aerial cable.
Figure 3:
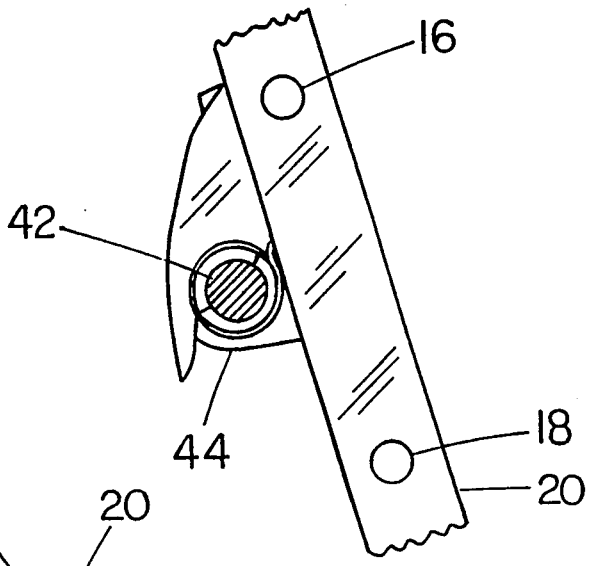
FIG. 3 is a partial side elevational view showing a portion of the ladder of FIG. 2 and a portion the apparatus of FIG. 1.

Referring now more particularly to the Figures, there is provided a safety device in the form of clamp 10 which is constructed so as to be readily attached between adjacent rungs of a ladder. Clamp 10 includes slot 12 located near the top thereof and slot 14 located near the bottom thereof. Slot 12 receives rung 16 of ladder 20, as shown in FIG. 2, and slot 14 receives rung 18 of ladder 20. Preferably the clamp is attached to the top two rungs of the ladder and is centered on the ladder for better balance. The ladder 20 with safety device or clamp 10 is attached to cable 42 between adjacent utility poles 2 and 4.

Slots 12 and 14 are spaced apart substantially the same distance as the space between adjacent rungs 16 and 18 so that the clamp may be snugly fitted between the adjacent rungs. Safety latch 22 is swivelably connected to the top portion of clamp 10 so that rung 16 is completely encircled by slot 12 and latch 22 when the latch is closed. Locking pin 24 is adapted to be received through holes 28 and 30 and through hole 26 of latch 22 for securing the latch 22 in place.

Clamp 10 includes two identical parallel plates 32 and 34. The plates are held apart by various spacers such as bolt or block 35, thereby forming a gap or space 36 between the plates. A swivelable portion 38 of cable lock 41 is connected to plates 32 and 34 by bolt 37. Bolt or block 39 is provided so that the swivelable portion 38 will not drop below the position shown in FIG. 1, thus the swivelable portion is in the ready position for receiving aerial cable 42 as shown in FIG. 6.

Figure 4:
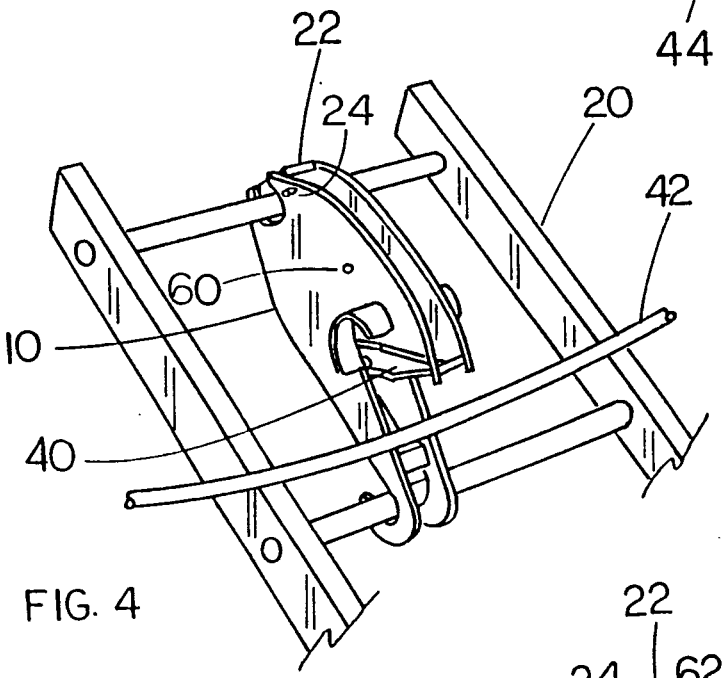
FIG. 4 is a partial pictorial view of the apparatus of FIG. 1 attached to a ladder prior to its attachment to an aerial cable.
Figure 6:
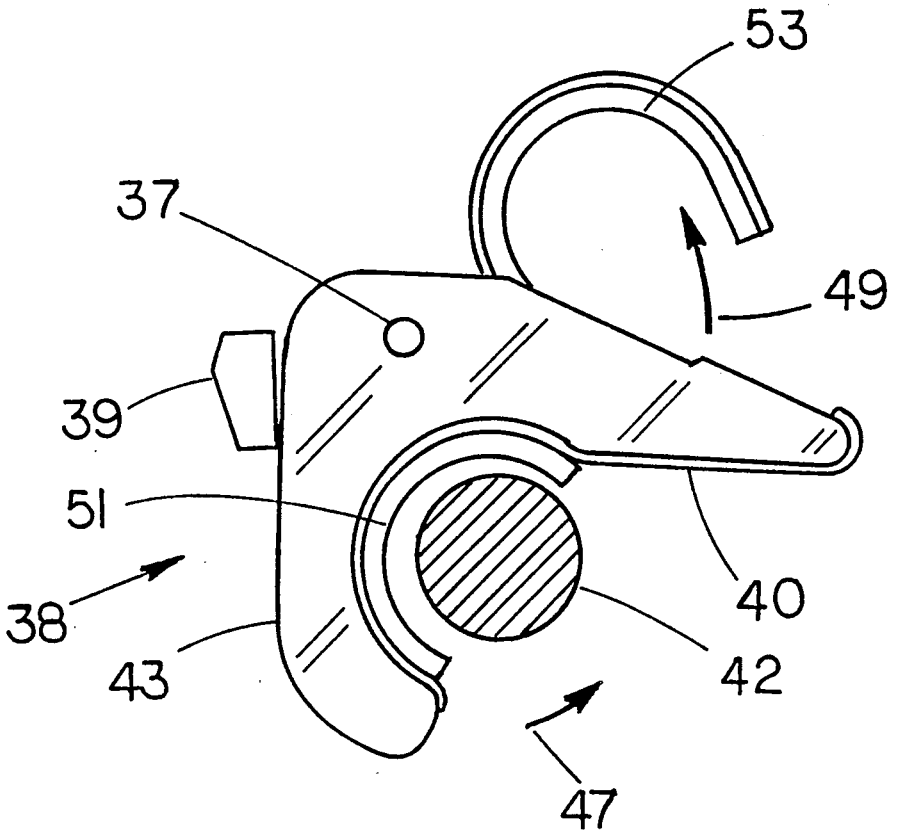
FIG. 6 is a partial side elevational view showing certain details of the locking mechanism of the apparatus of FIG. 1 as the aerial cable is being inserted into the locking mechanism.
Figure 8:
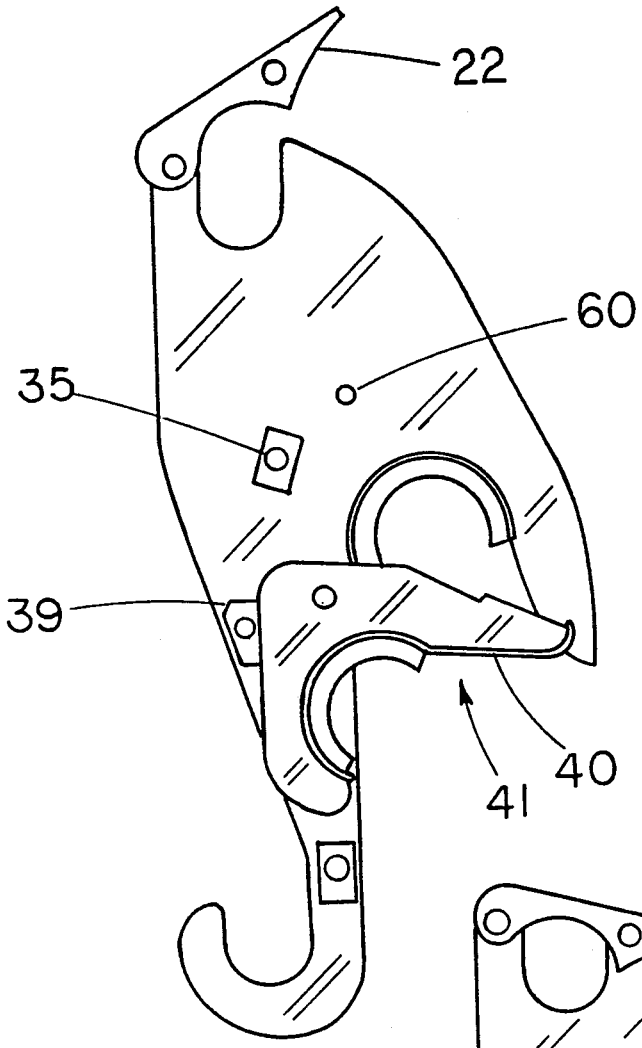
FIG. 8 is a side elevational view of the apparatus of FIG. 1 with one of the plates having been removed and with the swivelable portion of the locking mechanism in the downward position.

Also as shown in FIGS. 6 and 8, swivelable portion 38 includes finger 40 which is in the horizontal position prior to contact with aerial cable 42. Rear extension 43 contacts stop 39 which is in the form of a bolt, to keep finger 40 in the horizontal position. This may also be seen in reference to FIG. 4 which shows the clamp 10 attached to ladder 20 and in position prior to contact with aerial cable 42.

Figure 5:
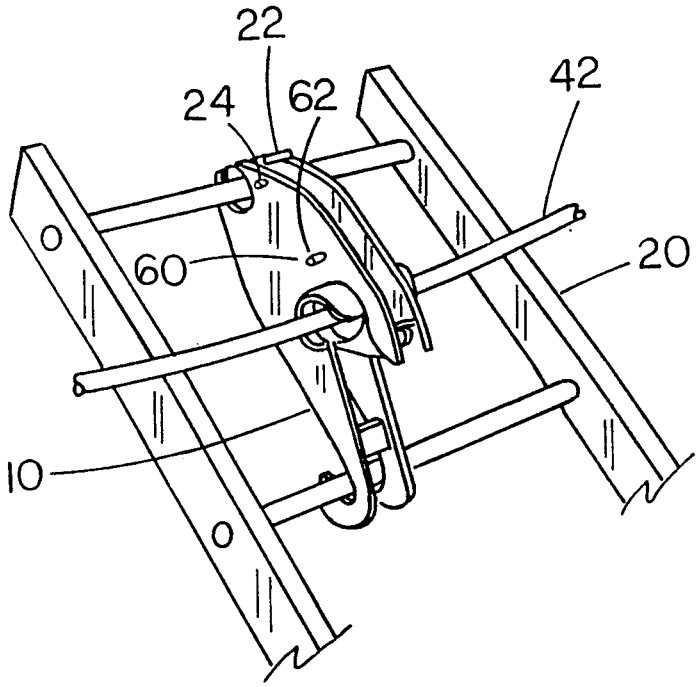
FIG. 5 is a partial pictorial view of the apparatus of FIG. 1 attached to a ladder and further attached to an aerial cable.

In order to make a connection with aerial cable 42, the ladder 20 is pulled downwardly after contact is made between aerial cable 42 and finger 40. As shown in FIG. 6, locking clamp 38 begins to rotate as indicated by arrows 47 and 49 and cable 42 makes contact with curved surface 51 of swivelable portion 38 of the lock 41. The swivelable portion is rotated 90 ° so that cable 42 becomes captured between curved surface 51 and curved surface 53 which is located above cavity 55 which forms another portion of the lock 41. Thus the ladder 20 and the aerial cable become firmly attached to one another by use of the clamp 10 as shown in FIG. 5. Downward pressure of surface 53 on aerial cable 42 and the fact that swivelable portion 38 can't move because of the cable 42 being in cavity 55 insures that the ladder is locked to the cable.

Figure 1:
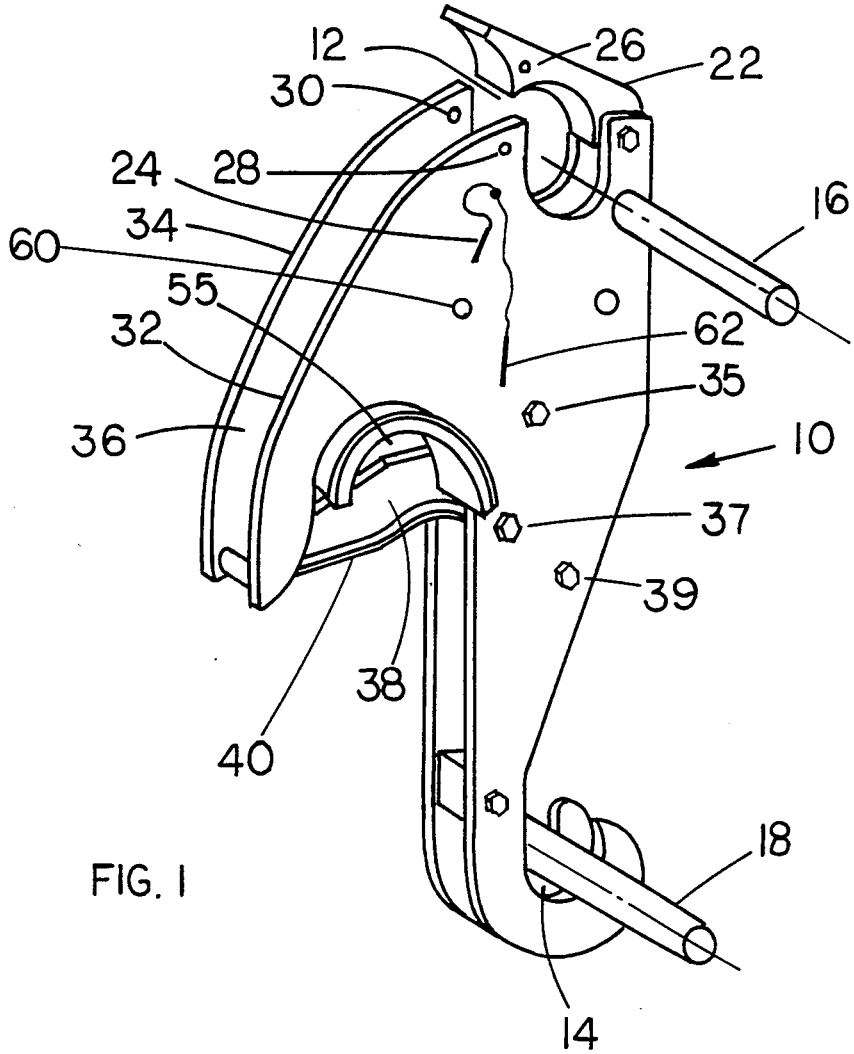
FIG. 1 is a pictorial view of the apparatus of the subject invention.
Figure 7:
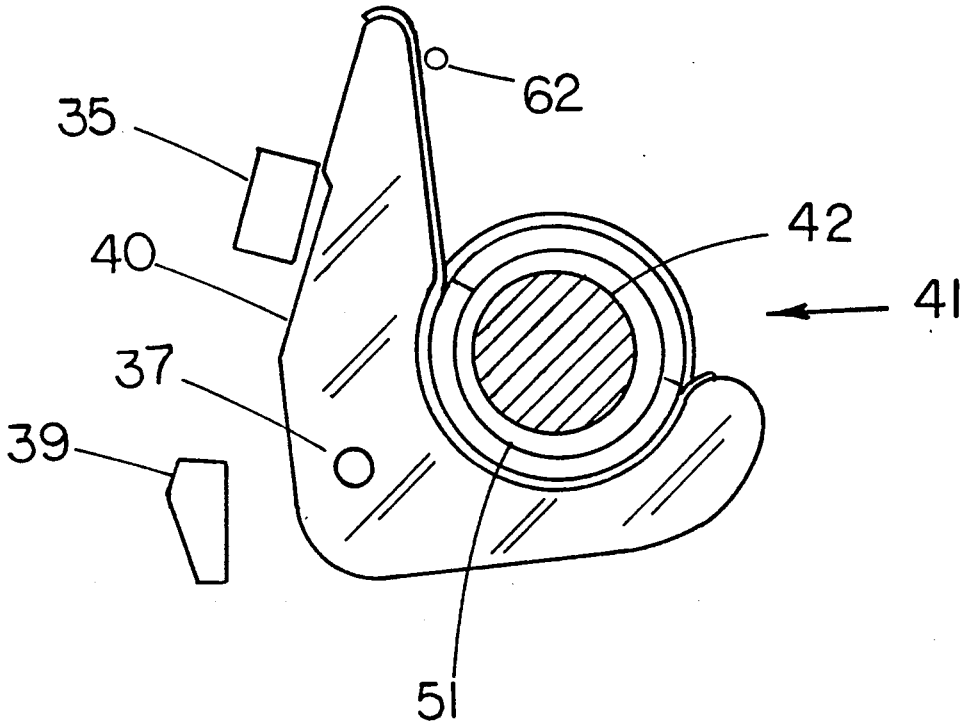
FIG. 7 is an side elevational view of the apparatus of FIG. 6 but with the aerial cable having been fully inserted into the locking mechanism.
Figure 9:
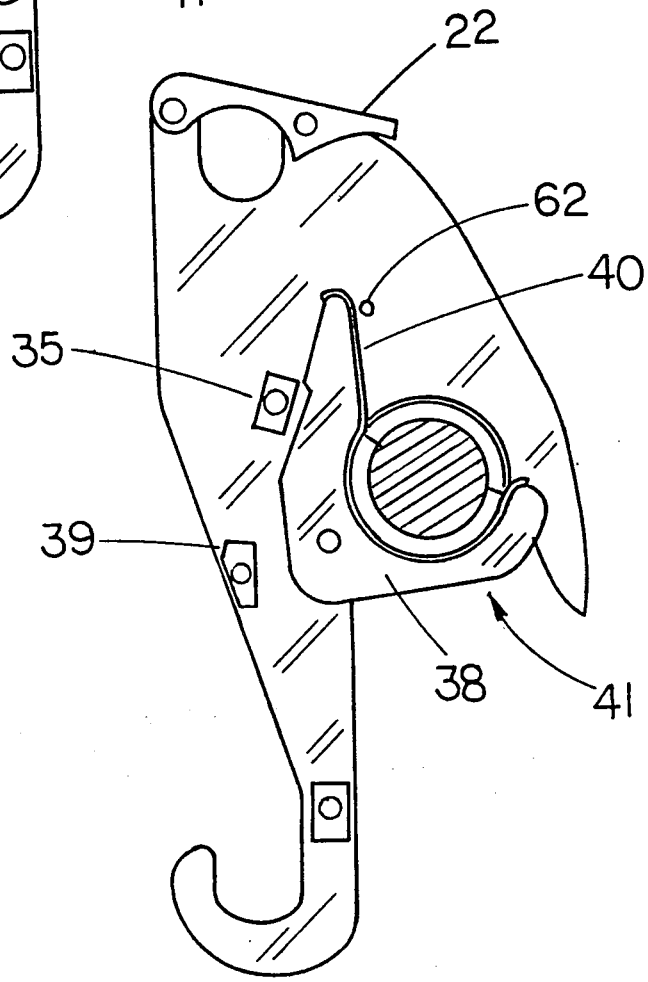
FIG. 9 is a side elevational view of the apparatus of FIG. 8 but with the swivelable portion of the locking mechanism in its upward position.

An additional insurance against an unintentional unlocking of clamp 10 from the ladder hole 60 is made through plates 32 and 34 and pin 62 is attached to plate 32 as shown in FIG. 1. After swivelable portion 38 has been placed in the up position as shown in FIGS. 5, 7 and 9, pin 62 is inserted through hole 60 so that finger 40 abuts against pin 62. Thus swivelable portion 38 can't inadvertently drop to the down position.

As may be seen in FIGS. 7 and 9, finger 40 will abut against stop 35 so that it will not continue to rotate. Cable 42 itself will prevent swivelable locking mechanism 38 from rotating in the other direction. Thus the locking mechanism 41 is essentially self locking. These preferably curved surfaces 51 and 53 are made of a soft electrical insulator such as rubber so as to protect the aerial cable and to insulate the user of the ladder from electrical shock. Using the clamp safety device described above, safety problems which have been associated with ladders falling when repairs or installation between utility poles are substantially lessened. In order to release the ladder from the aerial wire once the person steps off the ladder, pin 62 is removed from hole 60 and the ladder is pushed upwardly thereby permitting the swivelable portion 38 to rotate in the opposite direction to that shown in FIG. 6 thereby freeing the aerial cable from the clamp.

From the foregoing description of the preferred embodiment of the invention it is apparent that many modifications may be made therein without departing from the true spirit and scope of the invention.

I claim:

1. A safety device for use with a ladder comprising:

a clamp adapted to be connected to a ladder between a first rung and a second rung thereof;

means for securing said clamp to said first rung;

means for securing said clamp to said second rung;

a locking mechanism connected to said clamp for securing said clamp and thus the ladder to an aerial cable; said locking mechanism including a portion which is swivelably mounted to said clamp; said swivelable portion of said locking mechanism including a first surface for contacting the aerial cable whereby upon contacting the aerial cable said swivelable portion will rotate; a cavity located above said swivelable portion; said cavity forming a part of said locking mechanism; a second surface located in said cavity; said second surface contacting the aerial cable after said swivelable portion of said locking mechanism is rotated by contact with the aerial cable.

2. A safety device as set forth in claim 1 wherein said swivelable portion of said locking mechanism has a downward and an upward position.

3. A safety device as set forth in claim 2 further including means for securing said swivelable portion of said locking mechanism in is upward position after contact with the aerial cable.

4. A safety device as set forth in claim 1 wherein first and second surfaces are curved.

5. A safety device as set forth in claim 4 wherein said first and second surfaces are cushioned.

6. A safety device as set forth in claim 1 wherein said first and second surfaces are made of an electrical insulator.

7. A safety device as set forth in claim 1 wherein said means for securing said clamp to the first run includes a first slot.

8. A safety device as set forth in claim 7 further including a swivelable latch located adjacent to said first slot for enclosing said first slot when the rung is received in the first slot.

9. A safety device as set forth in claim 7 wherein said means for securing said clamp to the second rung includes a second slot.

10. A safety device as set forth in claim 9 wherein said second slot is in the form of an arc.

11. A safety device as set forth in claim 1 wherein said clamp is adapted to be located between adjacent rungs of the ladder.

12. A safety device for use with a ladder comprising:

a clamp adapted to be connected to a ladder between a first run and a second rung thereof;

means for securing said clamp to said first rung;

means for securing said clamp to said second rung;

a locking mechanism connected to said clamp for securing said clamp and thus the ladder to an aerial cable; said clamp includes a pair or parallel plates having a gap therebetween.

13. A safety device as set forth in claim 12 wherein said swivelable portion of said locking mechanism is adapted to rotate within said gap.

14. A safety device as set forth in claim 13 further including means for holding said swivelable portion locking mechanism in place after said aerial cable is received in said locking mechanism.

15. A safety device for use with a ladder comprising:

a clamp adapted to be connected to a ladder between a first run and a second rung thereof;

means for securing said clamp to said first rung;

means for securing said clamp to said second rung;

a locking mechanism connected to said clamp for securing said clamp and thus the ladder to an aerial cable; said locking mechanism including a portion which is swivelably mounted to said clamp; said swivelable portion of said locking mechanism includes an arm for making initial contact with said aerial cable thereby rotating said swivelable portion, and a surface for contacting said aerial cable during and after rotation of said swivelable portion; a second surface located above said swivelable portion for also contacting said cable after rotation of said swivelable portion.

16. A safety device for use with a ladder comprising:

a clamp adapted to be connected to the ladder between adjacent rungs thereof;

means for securing said clamp to said adjacent rungs including a first slot receiving one of said rungs and a second slot for receiving the other of said rungs; said slots being located on opposite ends of said clamp; said clamp including a pair of parallel spaced apart plates forming a gap therebetween;

a locking mechanism including a swivelable portion and a fixed portion; said swivelable portion adapted to rotate within said gap; said swivelable portion including a finger for making initial contact with an aerial cable; said finger having a curved surface for making contact with said aerial cable upon rotation of said swivelable portion; said fixed portion of said locking mechanism including a surface for making contact with said aerial cable after rotation of said swivelable portion.

* * * * *